US010770785B2

(12) United States Patent
Hayes et al.

(10) Patent No.: US 10,770,785 B2
(45) Date of Patent: Sep. 8, 2020

(54) PLASMA RADOME WITH FLEXIBLE DENSITY CONTROL

(71) Applicant: SMARTSKY NETWORKS LLC, Charlotte, NC (US)

(72) Inventors: Gerard James Hayes, Wake Forest, NC (US); Koichiro Takamizawa, Cary, NC (US); Donald L. Alcorn, Montgomery, AL (US); James O. Legvold, Willow Park, TX (US); Robert Michael Barts, Raleigh, NC (US)

(73) Assignee: SMARTSKY NETWORKS LLC, Morrisville, NC (US)

( * ) Notice: Subject to any disclaimer, the term of this patent is extended or adjusted under 35 U.S.C. 154(b) by 533 days.

(21) Appl. No.: 15/479,889

(22) Filed: Apr. 5, 2017

(65) Prior Publication Data

US 2018/0294561 A1 Oct. 11, 2018

(51) Int. Cl.
*H01Q 1/42* (2006.01)
*H01Q 19/06* (2006.01)
(Continued)

(52) U.S. Cl.
CPC ..... *H01Q 1/427* (2013.01); *H01Q 1/366* (2013.01); *H01Q 1/42* (2013.01); *H01Q 1/425* (2013.01);
(Continued)

(58) Field of Classification Search
CPC ..... H01Q 1/42; H01Q 1/422; H01Q 1/425; H01Q 1/526; H01Q 15/00; H01Q 19/06
(Continued)

(56) References Cited

U.S. PATENT DOCUMENTS 2,085,406 A 6/1937 Zworykin
7,772,774 B1 8/2010 Pavliscak et al.
(Continued)

FOREIGN PATENT DOCUMENTS

EP 0230969 A1 8/1987
JP 2014192651 A 10/2014
JP 2016032164 A 3/2016

OTHER PUBLICATIONS

Fuchs, et al., "Design Optimization of Multishell Luneburg Lenses," IEEE Transactions on Antennas and Propagation, IEEE Service Center vol. 55, No. 2, Feb. 1, 2007, all enclosed pages cited.
(Continued)

*Primary Examiner* — Hoang V Nguyen
(74) *Attorney, Agent, or Firm* — Burr & Forman, LLP

(57) ABSTRACT

An antenna assembly may include an antenna element, a radome structure disposed proximate to the antenna element and including a plurality of plasma elements, a driver circuit operably coupled to the plasma elements to selectively ionize individual ones of the plasma elements, and a controller. The controller may be operably coupled to the driver circuit to provide control of plasma density of the individual ones of the plasma elements. The plasma elements may include respective enclosures. At least some of the enclosures may have at least two peripheral edge surfaces substantially fully contacted by corresponding peripheral edge surfaces of adjacent enclosures at at least one section along a longitudinal length thereof.

22 Claims, 7 Drawing Sheets

(51) Int. Cl.
*H01Q 15/00* (2006.01)
*H01Q 1/36* (2006.01)
*H01Q 17/00* (2006.01)

(52) U.S. Cl.
CPC ..... *H01Q 15/006* (2013.01); *H01Q 15/0066* (2013.01); *H01Q 19/06* (2013.01); *H01Q 17/001* (2013.01)

(58) Field of Classification Search
USPC ..... 343/841, 702, 872, 906
See application file for complete search history.

(56) References Cited

U.S. PATENT DOCUMENTS

| | | | | |
|---|---|---|---|---|
| 7,999,747 | B1 * | 8/2011 | Wedding | H01Q 1/366 343/701 |
| 2003/0218575 | A1 * | 11/2003 | Walker | H01Q 1/366 343/853 |
| 2006/0220980 | A1 * | 10/2006 | Metz | H01Q 1/366 343/909 |
| 2009/0109115 | A1 * | 4/2009 | Dittrich | H01Q 1/422 343/841 |
| 2011/0025565 | A1 | 2/2011 | Anderson | |
| 2015/0214610 | A1 | 7/2015 | Kim et al. | |
| 2017/0264015 | A1 * | 9/2017 | Stratis | H01Q 3/34 |

OTHER PUBLICATIONS

International Search Report and Written Opinion of PCT/US2018/024504 dated Jun. 15, 2018, all enclosed pages cited.

* cited by examiner

PLASMA RADOME WITH FLEXIBLE DENSITY CONTROL

TECHNICAL FIELD

Example embodiments generally relate to plasma antenna technology and, more particularly, relate to the provision of a plasma radome for use with an antenna to flexibly control the functioning of the antenna.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

Traditionally, antennas have been defined as metallic devices for radiating or receiving radio waves. The paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for a wide range of applications.

More recently, some attention has been paid to the highly reconfigurable nature of plasma for use in and with antennas. In particular, plasma has the ability to turn on and off quickly, and can be extremely flexible in terms of rapid reconfiguration. Accordingly, for example, a plasma element can be configured to rapidly change characteristics that may impact the ability of the plasma element to transmit, receive, filter, reflect and/or refract radiation. Given the significant increases in flexibility and configurability that can be achieved using plasma, recent attention has been paid to improve antenna designs that employ plasma elements in one way or another.

BRIEF SUMMARY OF SOME EXAMPLES

Some example embodiments may therefore be provided in order to enable the provision of an antenna element whose radiating characteristics may be controlled in a very flexible way by the addition of a plasma radome proximate to the antenna element. The plasma radome may have a unique shape to prevent leakage around the plasma elements therein, but may also allow for flexible and intelligent control of the ionization of the plasma elements to allow the radiation pattern of the antenna element to be strategically controlled. Example embodiments may therefore provide for the use of a plasma radome in connection with an antenna element in a way that produces a highly flexible and configurable communication structure that can be implemented in a desired manner on the basis of requirements for specific missions or applications. With such a system, aircraft or other communication platforms can take full advantage of the unique attributes of plasma elements to improve flexibility and performance.

In one example embodiment, an antenna assembly is provided. The antenna assembly may include an antenna element, a radome structure disposed proximate to the antenna element and including a plurality of plasma elements, a driver circuit operably coupled to the plasma elements to selectively ionize individual ones of the plasma elements, and a controller. The controller may be operably coupled to the driver circuit to provide control of plasma density of the individual ones of the plasma elements. The plasma elements may include respective enclosures. At least some of the enclosures may have all peripheral edge surfaces substantially fully contacted by corresponding peripheral edge surfaces of adjacent enclosures at at least one section along a longitudinal length thereof.

In another example embodiment, a radome structure for an antenna assembly is provided. The radome structure may include a plurality of plasma elements operably coupled to a driver circuit. The driver circuit may be configured to selectively ionize individual ones of the plasma elements responsive to operation of a controller operably coupled to the driver circuit to provide control of a plasma density of the individual ones of the plasma elements. The plasma elements may include respective enclosures. At least some of the enclosures have all peripheral edge surfaces substantially fully contacted by corresponding peripheral edge surfaces of adjacent enclosures at at least one section along a longitudinal length thereof.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
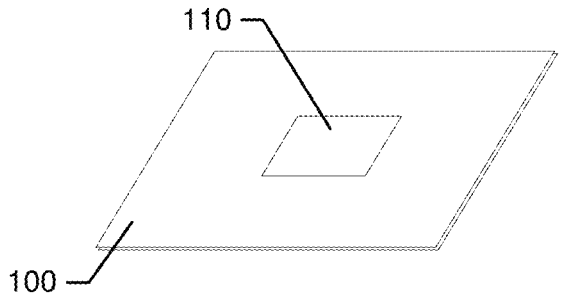
FIG. 1 illustrates a perspective view of a microstrip patch antenna disposed on a substrate without a radome.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements such as reference numerals refer to like elements throughout. Furthermore, as used herein, the term "or" is to be interpreted as a logical operator that results in true whenever one or more of its operands are true. As used herein, the terms "data," "content," "information" and similar terms may be used interchangeably to refer to data capable of being transmitted, received and/or stored in accordance with example embodiments. As used herein, the phrase "operable coupling" and variants thereof should be understood to relate to direct or indirect connection that, in either case, enables functional interconnection of components that are operably coupled to each other. Thus, use of any such terms should not be taken to limit the spirit and scope of example embodiments.

Plasma elements of an example embodiment may generally be formed of plasma containers having selected shapes and selected spatial distributions. The plasma containers may have variable plasma density therein, and plasma frequencies may be established in ranges from zero to arbitrary plasma frequencies based on controlling plasma density.

Some of the physics of plasma transparency and reflection are explained as follows. The plasma frequency is proportional to the density of unbound electrons in the plasma or the amount of ionization in the plasma. The plasma frequency sometimes referred to a cutoff frequency is defined as:

$$\omega_p = \sqrt{\frac{4\pi n_e e^2}{me}}$$

where $\eta_e$ is the density of unbound electrons, e is the charge on the electron, and me is the mass of an electron. If the incident RF frequency ω on the plasma is greater than the plasma frequency $\omega_p$ (i.e., when $\omega > \omega_p$), the electromagnetic radiation passes through the plasma and the plasma is transparent. If the opposite is true, and the incident RF frequency ω on the plasma is less than the plasma frequency $\omega_p$ (i.e., when $\omega < \omega_p$), the plasma acts essentially as a metal, and transmits and receives electromagnetic radiation.

Accordingly, by controlling plasma frequency, it is possible to control the behavior of the plasma antenna element for various applications. The electronically steerable and focusing plasma reflector antenna of the present inventor has the following attributes: the plasma layer can reflect microwaves and a plane surface of plasma can steer and focus a microwave beam on a time scale of milliseconds.

The definition of cutoff as used here is when the displacement current and the electron current cancel when electromagnetic waves impinge on a plasma surface. The electromagnetic waves are cutoff from penetrating the plasma. The basic observation is that a layer of plasma beyond microwave cutoff reflects microwaves with a phase shift that depends on plasma density. Exactly at cutoff, the displacement current and the electron current cancel. Therefore there is an anti-node at the plasma surface, and the electric field reflects in phase. As the plasma density increases from cutoff the reflected field increasingly reflects out of phase. Hence the reflected electromagnetic wave is phase shifted depending on the plasma density. This is similar to the effects of phased array antennas with electronic steering except that the phase shifting and hence steering and focusing comes from varying the density of the plasma from one tube to the next and phase shifters used in phased array technology is not involved.

This allows using a layer of plasma tubes to reflect microwaves. By varying the plasma density in each tube, the phase of the reflected signal from each tube can be altered so the reflected signal can be steered and focused in analogy to what occurs in a phased array antenna. The steering and focusing of the mirror can occur on a time scale of milliseconds. This structure, or others, may be employed in plasma antenna elements of example embodiments. Moreover, regardless of the particular structure employed, example embodiments may enable the plasma antenna element to be operated according to the general principles described above, but require less power to achieve desired plasma densities, and also intelligently select plasma densities in some cases. In an example embodiment, the control of plasma density may be accomplished by controlling the pulse width of the driving current used to ionize the plasma.

Based on the description above, it should be appreciated that plasma structures can be designed and configured to act as a radiating element, a reflecting surface, or a dielectric layer. Moreover, through the control of plasma density, a single plasma structure or element can function as a combination of those elements over a desired frequency band. Given these characteristics, a plasma element can be configured to have unique properties when combined with other structures as well. For example, some example embodiments described herein may provide a unique application of plasma elements arranged in a layered pattern over a radiating structure in order to enhance or control the radiation pattern of the radiating structure. The layered pattern may form a radome relative to the radiating structure (which could be any type of radiating structure).

Of note, conventionally, plasma elements have often been defined as cylindrically shaped tubes inside which plasma is ionized. These cylindrically shaped tubes, when placed adjacent to each other, typically experienced some amount of leakage around the sides of the tubes via the air gaps created between the tubes. For optimal efficiency relative to control of the output of the radiating structure, this leakage should be minimized. Accordingly, some example embodiments further provide a structure that optimizes efficiency by nearly eliminating leakage paths proximate to the plasma elements. Each of the plasma elements may then be controlled to achieve a desired electrical response (e.g., from conductor to dielectric insulator) such that the resulting structure allows for the creation of a unique distribution of electrical response that cannot be achieved in a typical, monolithic radome structure.

FIG. 1 illustrates a concept diagram showing a portion of an aircraft skin 100 having a microstrip patch antenna 110 disposed thereon. Of note, the aircraft skin 100 could be any portion of the aircraft, such as the wing, fuselage, tail, etc. Moreover, the aircraft skin 100 could be replaced by any other structure (land based, sea based, or air based) upon which it may be desirable to mount communication equipment such as the patch antenna 110. Additionally, the patch antenna 110 is merely one example of a radiating structure that could be used in connection with example embodiments. Thus, it should be appreciated that any other radiating structure (e.g., antenna element) could be substituted for the patch antenna 110. Moreover, in some cases, the radiating structure itself could be a plasma antenna element. However, conventional antenna structures and other antenna assemblies are also possible.

Figure 2:
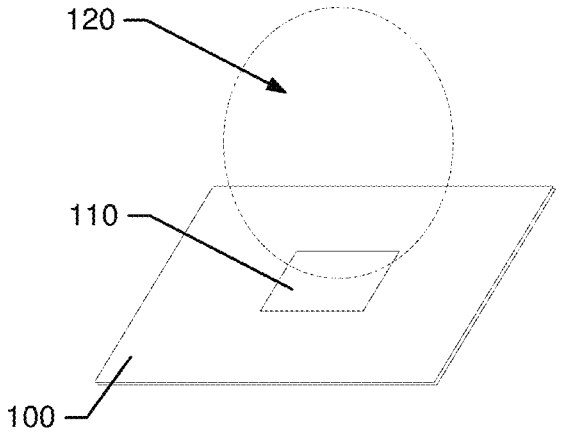
FIG. 2 illustrates a radiation pattern that may be generated from the structure of FIG. 1.

In this example, the patch antenna 110 may be expected, when operated, to generate a somewhat omnidirectional radiation pattern 120. The radiation pattern 120 may be different for corresponding different radiating structures and may depend upon the specific characteristics of the radiating structures themselves. However, regardless of the specific radiating structure employed, it can be appreciated that the radiation pattern 120 is often desirably uninhibited by the radome employed to protect the radiating structure. As such, conventional radomes are often designed to be structurally rugged, but transparent to RF energy. Thus, a desirable conventional radome might be expected to have no impact (or at least minimal impact) on the radiation pattern 120 generated by the patch antenna 110 shown in FIG. 2.

In accordance with an example embodiment, a radome structure may be provided over the patch antenna 110 to selectively enable control or modification of the radiation pattern 120. In particular, the radome structure may be configurable in real time to control the characteristics of the radiation pattern in any desirable way based on the plasma density of individual elements of the radome structure. The radome structure may be provided proximate to or enclose the radiating structure (e.g., the patch antenna 110) and may therefore allow modification of the radiation pattern by changing the plasma density in selected ones of the individual elements of the radome structure. In some cases, the radome structure may be defined by layers of plasma elements that form a planar structure or sheet. For coverage of a microstrip antenna like the patch antenna 110, the radome structure may simply be a sheet of material formed to cover the patch antenna 110 and lie in a plane substantially parallel to the surface of the aircraft skin 100. However, for other structures such as protruding antenna elements, the radome structure could be defined by multiple sheets attached to each other to form an enclosure around the radiating structure.

Figure 3:
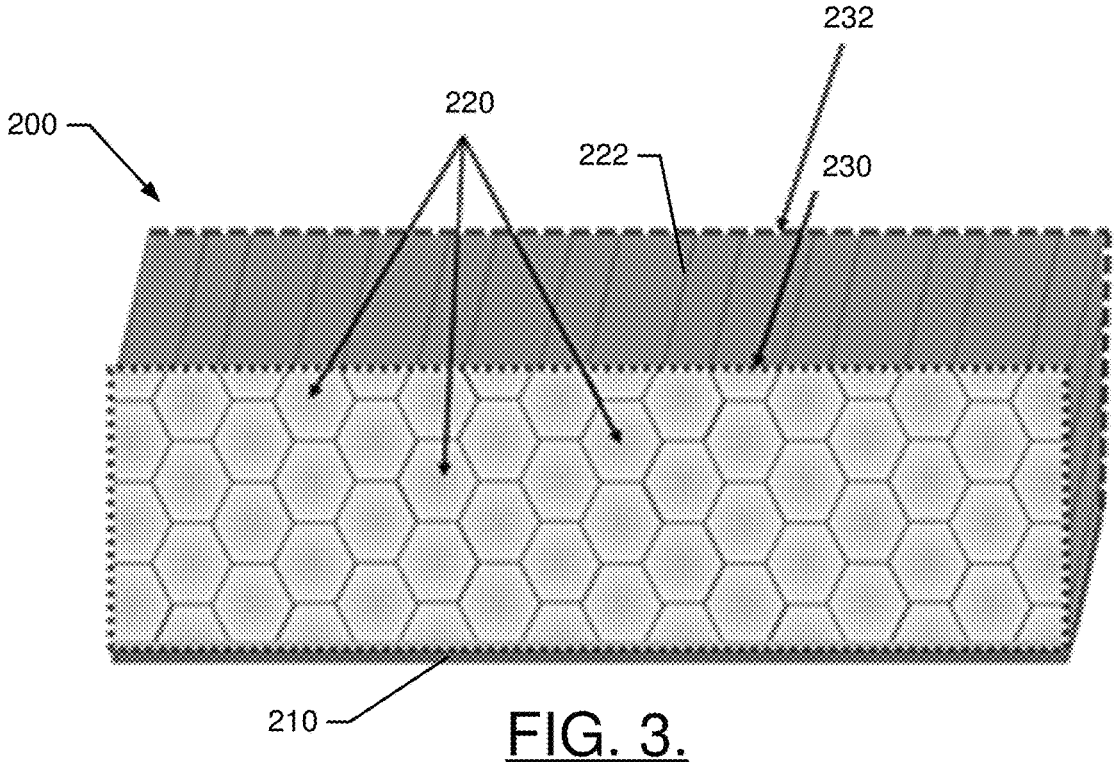
FIG. 3 illustrates a perspective view of a radome structure in accordance with an example embodiment.

FIG. 3 illustrates a perspective view (not necessarily drawn to scale) of a radome structure 200 in accordance with an example embodiment. The radome structure 200 is disposed proximate to a patch antenna 210 (as on example of an antenna element with which example embodiments may be utilized). In this case, the radome structure 200 may be immediately adjacent to the patch antenna 210 and actually contact a surface of the patch antenna 210. However, it is also possible that an air gap could be provided between the patch antenna 210 (or some other radiating structure) and the radome structure 200.

The radome structure 200 is formed by placing a plurality of plasma elements 220 that are each defined by an enclosure 222 and ionizable gas retained inside the enclosure 222. As shown in FIG. 3, each enclosure 222 has an elongated hexagonal shape. In other words, each enclosure 222 has a hexagonal shaped cross section and extends linearly in a direction (i.e., a longitudinal direction of extension) that may be substantially parallel to the plane in which the patch antenna 210 lies. The longitudinal direction of extension of each of the enclosures 222 may be substantially parallel to the longitudinal direction of extension of each adjacent enclosure 222 as well. Since the enclosures 222 have a hexagonal shape, every enclosure 222 that is disposed at an interior portion of the radome structure 200 may have six adjacent enclosures extending parallel thereto, and in contact therewith. Enclosures 222 disposed at top or bottom surfaces of the radome structure 200 may have as few as three adjacent enclosures 222. In some cases, edges that form the top or bottom surfaces of the radome structure 200 may be made substantially continuous or smooth by the inclusion of filler materials or partial enclosures between other enclosures 222 that are fully hexagonal in shape.

As can be appreciated from FIG. 3, whereas a cylindrically shaped enclosure would contact each adjacent enclosure at no more than a single series of points extending along the longitudinal lengths thereof, each adjacent side of the hexagonally shaped enclosures 222 has substantially full contact with every one of its adjacent enclosures 222 over the corresponding adjacent planar surfaces full length of extension. Thus, leakage around and between enclosures 222 is minimal and better control can be achieved. The resulting appearance of the structure created by the collective arrangement of the enclosures 222 resembles that of a honeycomb. In this regard, the honeycomb structure formed may include multiple layers of plasma elements 220 and each layer, and/or selected plasma elements 220 within any given layer, can be controlled (e.g., relative to the plasma density maintained therein) to correspondingly control the locations through which radiation generated by the patch antenna 210 can pass and the nature of any impact on the radiation as it passes therethrough.

However, it should also be appreciated that the advantages provided by the honeycomb structure can be approximated with enclosures having other geometries as well so long as the geometries permit assembly of the radome structure 200 in a way that prevents leakage between adjacent enclosures. In particular, any structure that results, when such enclosures are assembled to form the radome structure 200, in all enclosures that are surrounded by adjacent enclosures on all sides to have substantially full contact with every one of its adjacent enclosures about its entire periphery along longitudinal sides thereof. Thus, edge enclosures may be different since at least one side may not have an adjacent enclosure. However, for interior enclosures, all peripheral edges thereof are substantially fully contacted by corresponding surfaces of adjacent enclosures along at least a majority of the length of the longitudinal sides thereof. As such, square shapes, rectangular shapes, triangular shapes, or other such shapes may alternatively be employed in some example embodiments.

In some embodiments a first control surface 230 may be disposed at a first longitudinal end of each of the plasma elements 220. Meanwhile, a second control surface 232 may be disposed at a second longitudinal end (i.e., the opposing end relative to the first longitudinal end) of the plasma elements 220. The first and second control surfaces 230 and 232 may be defined by a series of individually addressable or selectable electrodes. The electrodes may be individually selectable in pairs at opposing ends of particular ones of the plasma elements 220 to allow individual plasma elements 220 to be ionized to control plasma density inside the corresponding enclosures 222. The individual plasma elements 220 may therefore have their respective plasma densities strategically controlled to control the behavior of the plasma therein relative to passing, blocking or acting as a lens relative to the radiation pattern generated by the patch antenna 210. Moreover, groups of the individual plasma elements 220 may be controlled to define specific patterns that allow steering of beams from the patch antenna 210 as described herein.

Figure 4:
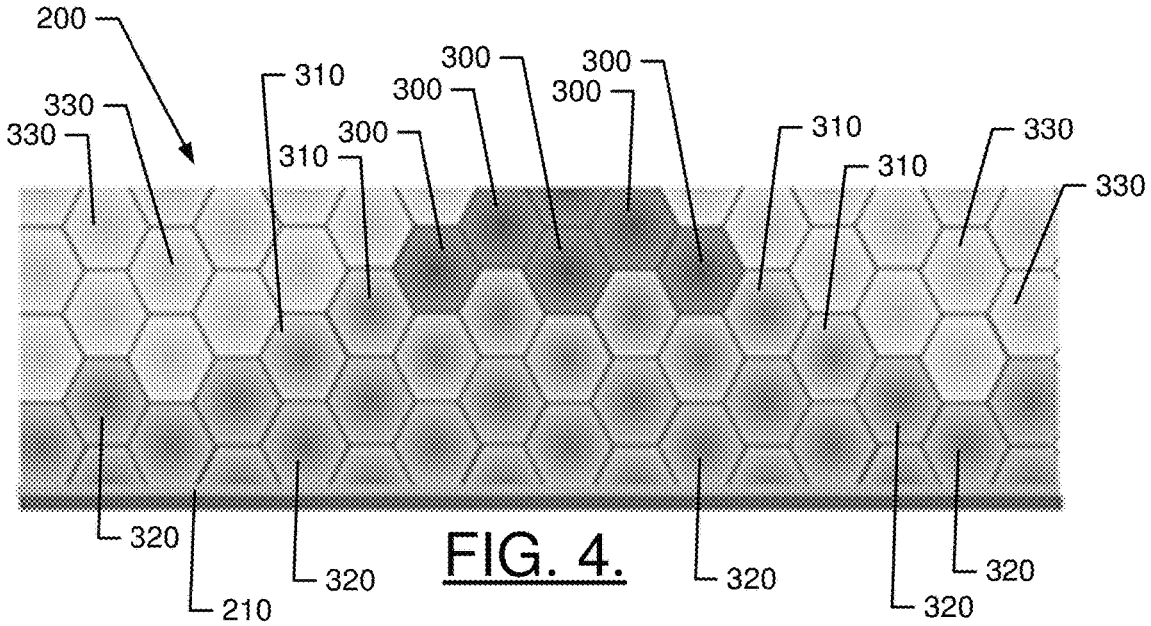
FIG. 4 illustrates how different plasma densities can be provided in respective different groups of plasma elements of the radome structure in accordance with an example embodiment.

FIG. 4 shows a side view of the radome structure 200 to illustrate how particular sets of plasma elements 220 may be selected for different densities. In this regard, a first group of elements 300 may each be ionized to a first plasma density, a second group of elements 310 may be ionized to have a second plasma density, a third group of elements 320 may be ionized to have a third plasma density, and a fourth group of elements 330 may have a fourth plasma density. In an example embodiment, the fourth group of elements 330 may not have ionization energy applied thereto, while the first, second and third groups of elements 300, 310 and 320 have respective different levels of ionization. For example, the first group of elements 300 may have a highest ionization energy and corresponding plasma density, while the third group of elements 320 has a lowest ionization energy and corresponding plasma density. However, opposite ionization energies could also be applied or any other combination of different ionization energies could be applied to the defined groups shown in FIG. 4 or to other combinations of cells defining different groupings. The selective application of ionization energies to different groups of cells allows various different controls to be applied to shape the radiation pattern emanating through the radome structure 200.

Figure 5:
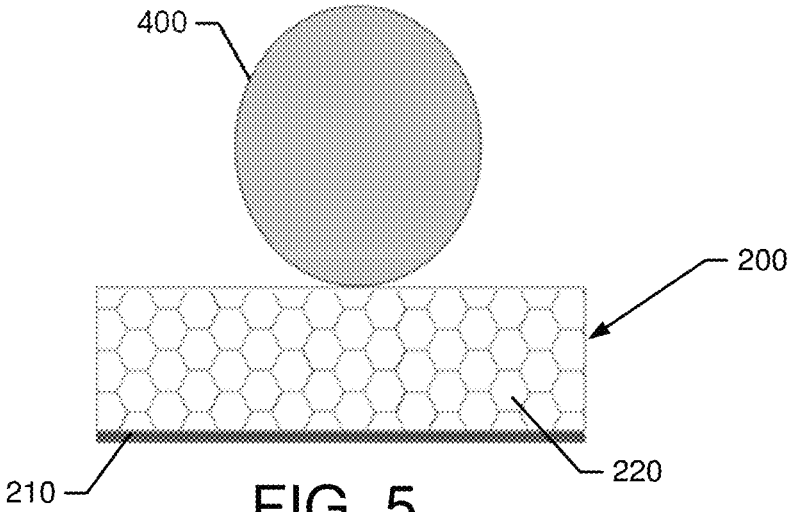
FIG. 5 illustrates a radiation pattern that may be generated when all plasma elements of the radome structure are not ionized in accordance with an example embodiment.
Figure 6:
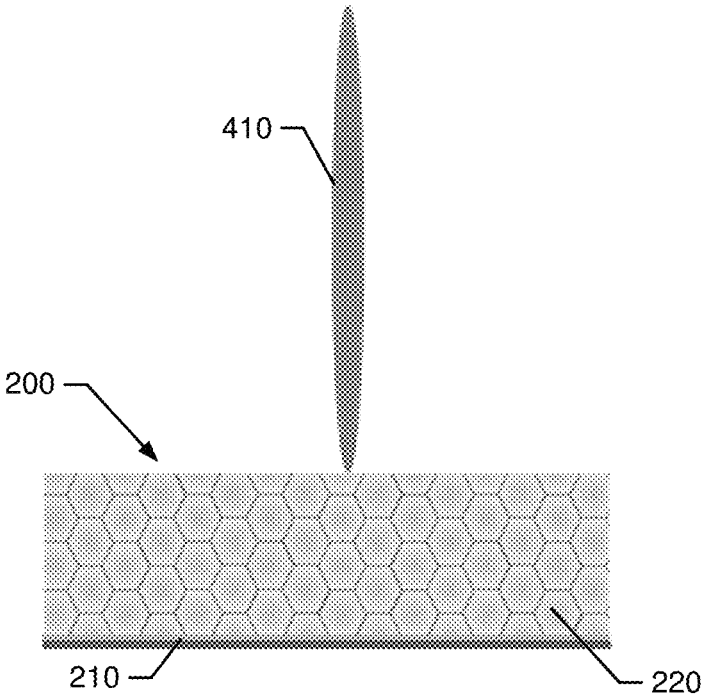
FIG. 6 illustrates a radiation pattern that may be generated when all plasma elements of the radome structure are uniformly ionized in accordance with an example embodiment.

In this regard, for example, if all of the elements are not ionized (i.e., in an off state), then the radiation pattern 400 of FIG. 5 may be formed. This radiation pattern 400 is similar to the radiation pattern 120 of FIG. 2, since the plasma elements 220 are effectively invisible and have no impact on the radiation pattern 400 in the example of FIG. 5. However, if the plasma elements 220 of the radome structure 200 are all excited with a uniform distribution (as shown in FIG. 6), the beam generated by the patch antenna 210 may be modified from the radiation pattern 400 shown in FIG. 5 to a focused beam 410 shown in FIG. 6. Furthermore, by controlling the plasma density in selected ones of the plasma elements 220 in various patterns or combinations, the focused beam 410 of FIG. 6 may be controlled (i.e., steered or otherwise manipulated) directionally. In this regard, FIG. 7 shows a right steered beam 412 that has been deflected to the right and FIG. 8 shows a left steered beam 414 that has been steered to the left relative to the focused beam 410 of FIG. 6.

Figure 7:
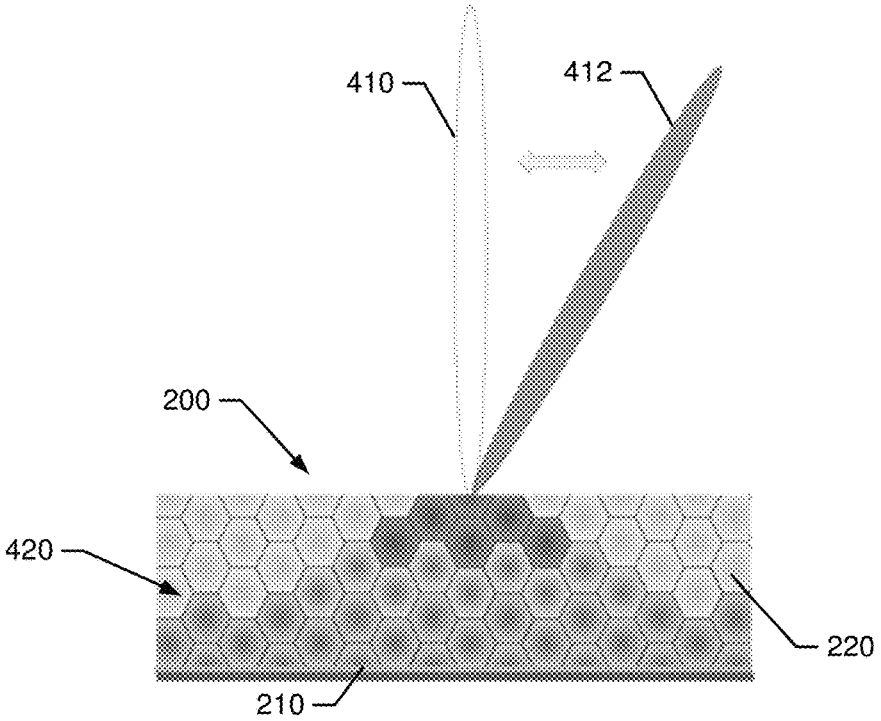
FIG. 7 illustrates steering of the radiation pattern to the right based on a pattern of controlling plasma density distribution in accordance with an example embodiment.
Figure 8:
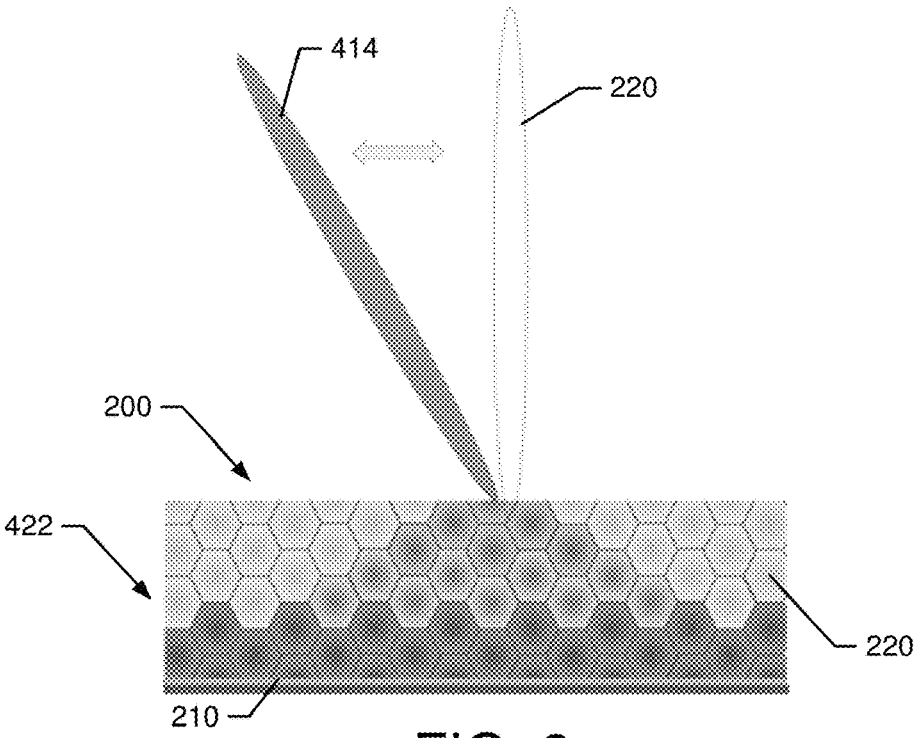
FIG. 8 illustrates steering of the radiation pattern to the left based on a pattern of controlling plasma density distribution in accordance with an example embodiment.
Figure 9:
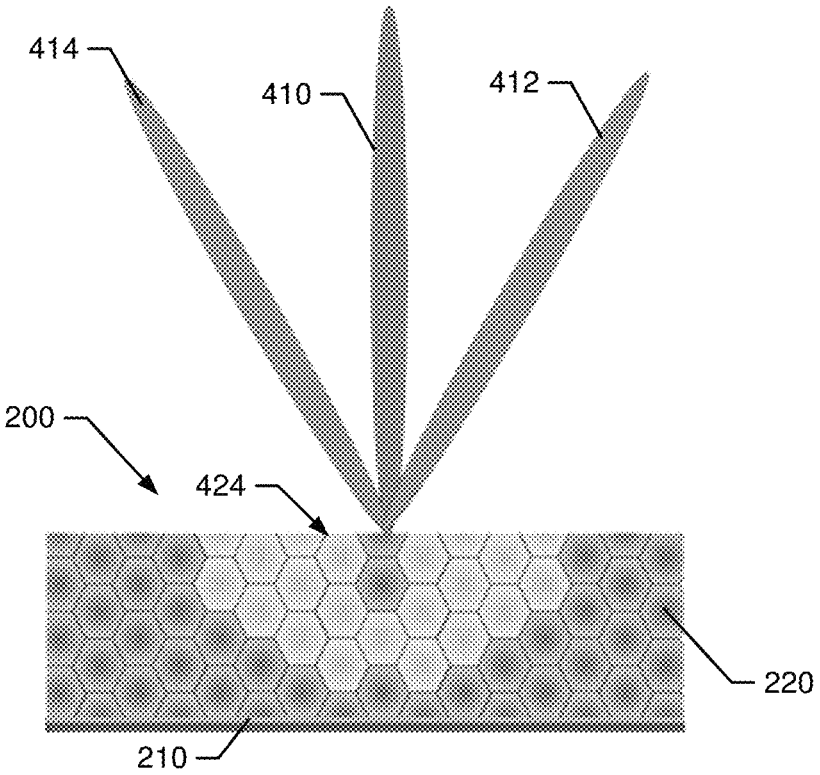
FIG. 9 illustrates simultaneous generation of multiple radiation patterns based on a pattern of controlling plasma density distribution in accordance with an example embodiment.

As can be appreciated from FIGS. 7 and 8, by employing a first excitation pattern 420 with selected ones of the plasma elements 220 ionized to corresponding different plasma densities having a first pattern, the steered beam 412 can be deflected to the right and by employing a second excitation pattern 422 with selected ones of the plasma elements 220 ionized to corresponding different plasma densities having a second pattern, the steered beam 412 can be deflected to the left. Furthermore, as shown in FIG. 9, the radome structure 200 may be selectively ionized to generate multiple beams simultaneously. In this regard, a third excitation pattern 424 for providing different plasma densities within the plasma elements 220 is selected in the example of FIG. 9. The third excitation pattern 424 effectively focuses and steers three beams simultaneously (e.g., the focused beam 410, the right steered beam 412 and the left steered beam 414. It should be appreciated that more or fewer beams could be formed and steered simultaneously and at different directions by further controlling the patterns of plasma densities selected for the plasma elements 220. Moreover, after appreciating the method and structures for controlling the plasma densities as described herein, one of skill in the art will find that a number of different combinations of patterns of ionization (and corresponding plasma density distributions) can be experimented with to identify corresponding beam steering results that may be desirable.

Figure 10:
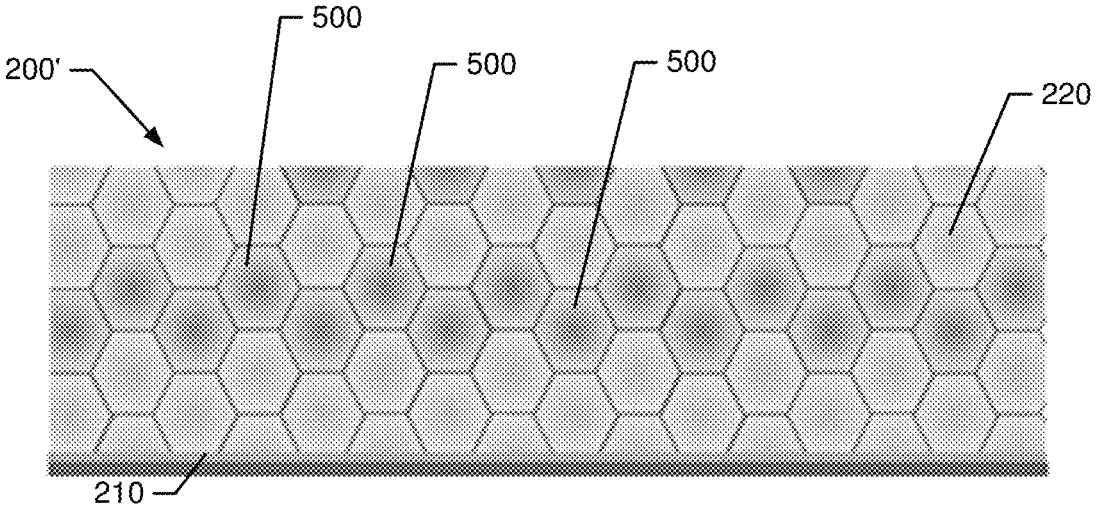
FIG. 10 illustrates a radome structure that includes at least some non-plasma enclosures in accordance with an example embodiment.

In some example embodiments, it may be desirable to have some of the enclosures that are provided in the honeycomb structure be filled with material other than plasma. For example, non-plasma elements 500 may be distributed into a radome structure 200' in any desirable pattern as shown in FIG. 10. The non-plasma elements 500 may include a fixed dielectric or metallic material in an enclosure that substantially shares the same shape as the shape of the enclosures 222 (see FIG. 3) of the plasma elements 220 to ensure that leakage is not permitted between adjacent enclosures. Moreover, in some cases, the non-plasma elements 500 may be non-homogeneous in their composition so that, for example, dielectric materials and metallic materials may be included in the same mon-plasma elements 500. The non-plasma elements 500 can be employed to reduce the cost of production of the radome structure 200' by reducing the number of plasma elements 220 needed to completely construct the radome structure 200' to have a desired size. However, in other examples, the non-plasma elements 500 may further allow distinct patterns or properties to be achieved when combined with corresponding plasma density patterns employed in the plasma elements 220. The non-plasma elements 500 may be distributed in a pattern, to define one or more layers within the radome structure 200', or in any other desirable manner.

Figure 11:
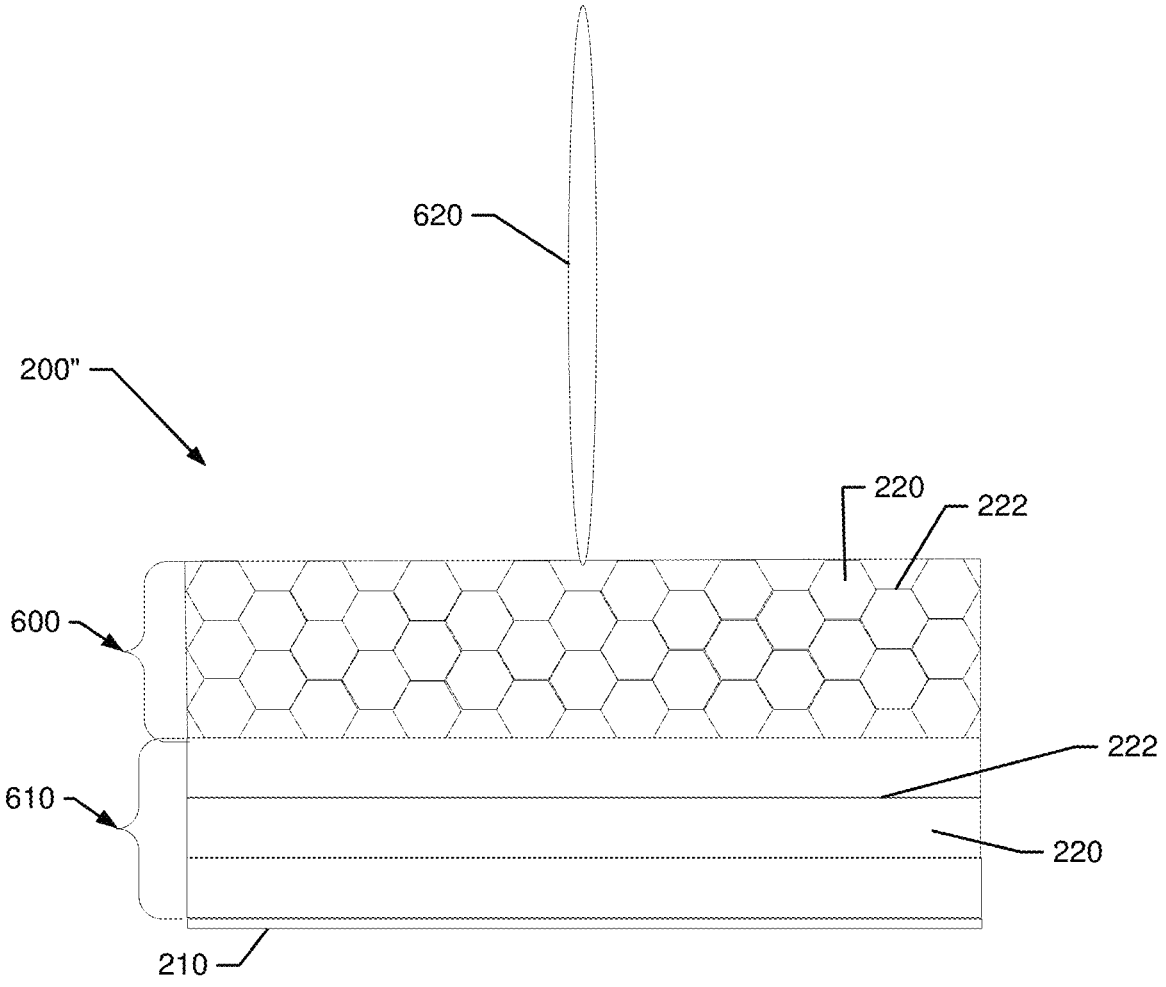
FIG. 11 illustrates a multi-layer radome structure employing plasma elements that lie orthogonal to each other in accordance with an example embodiment.

The examples shown in FIGS. 4-10 above all illustrate a cross sectional view of the radome structure 200 along a line orthogonal to the longitudinal length of the plasma elements 220. Thus, the beams (e.g., 410, 412 and 414) generated should also be appreciated to extend into the page and out of the page. In other words, the beams (e.g., 410, 412 and 414) have a narrow width, but not necessarily a narrow length in the examples above. In order to define a more focused beam (i.e., narrow in length and width), layers of plasma elements lying orthogonal (or rotated) relative to each other may be employed. For example, as shown in FIG. 11, a radome structure 200" may be defined to include a first layer 600 of plasma elements 220 having enclosures 222 that extend in a first direction, and a second layer 610 of plasma elements 220 having enclosures 222 that extend in a second direction that is substantially perpendicular to the first direction. The patch antenna 210 may have its radiation pattern modified to generate a resultant beam 620 that is narrow in both length and width dimensions. More layers than just two can also be employed in some cases. The resulting structures may allow for customized, anisotropic response where one polarization can be impacted differently from another.

As can be appreciated from the examples described above, the radome structures achievable by employing example embodiments can be operably coupled to an antenna assembly to modify the radiation pattern of the antenna assembly. As such, the radome structures described herein can be used with a device or system in which a component (e.g., a controller) is provided to control operation of a plurality of plasma elements housed within an enclosure that is shaped to have substantially all peripheral edges thereof in contact with corresponding edge surfaces of an adjacent enclosure to prevent leakage between enclosures. The controller can control the plasma elements of the radome structure and the resultant antenna element may be operated to function as a radiating antenna, a receiving antenna, a reflector or a lens to manipulate radio frequency (RF) signals associated with wireless communication or other applications. The arrangements of the antenna element or elements of some example embodiments may allow the controller to configure the plasma elements to support communication over one or multiple frequencies sequentially, simultaneously and/or selectively. Accordingly, plasma element advantages including low thermal noise, invisibility to radar when switched off or to a lower frequency than the radar, resistance to electronic warfare, plus the versatility provided by dynamic tuning and reconfigurability for frequency, direction, bandwidth, gain, and beamwidth in both static and dynamic modes of operation, may be provided to a platform (e.g., an aircraft) hosting the plasma elements forming the radome structure and the antenna elements included therewith.

Some example embodiments may employ characteristics of stealth, interference resistance and rapid reconfigurability in order to provide an adaptable and highly capable mobile communication platform. Moreover, example embodiments provide for the intelligent control of the plasma density of the plasma elements in any desirable pattern to achieve various results in terms of beam formation and steering. In some cases, the controller onboard the platform may respond to external stimuli (e.g., user input or environmental conditions) or follow internal programming to make inferences and/or probabilistic determinations about how to steer beams, select array lengths, employ channels/frequencies for communication with various communications equipment. Load balancing, antenna beam steering, interference mitigation, network security and/or denial of service functions may therefore be enhanced by the operation of some embodiments.

Figure 12:
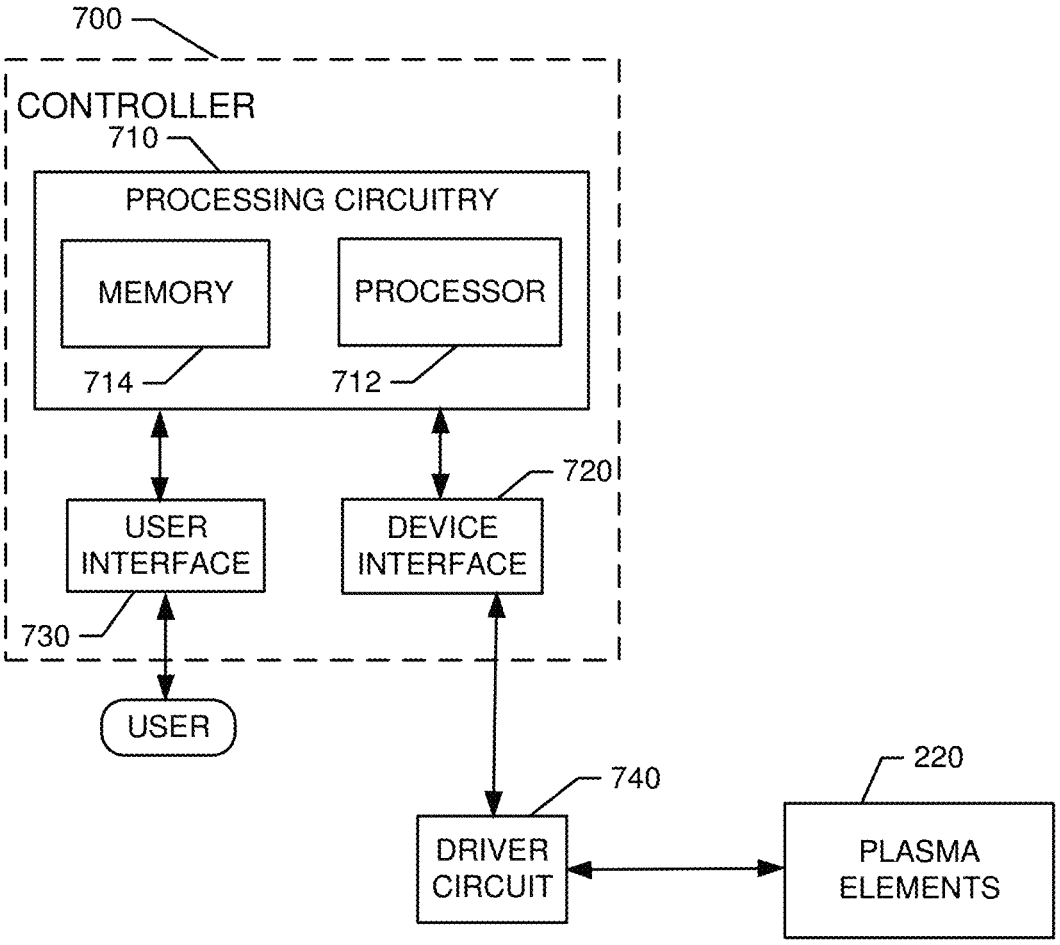
FIG. 12 illustrates a block diagram of a controller for controlling plasma density in various plasma elements in accordance with an example embodiment.

FIG. 12 illustrates one possible architecture for implementation of a controller 700 that may be utilized to control configuration of the radome structure 200 (or at least of an individual layer of a radome such as the radome structure 200" of FIG. 11) in accordance with an example embodiment. The controller 700 may include processing circuitry 710 configured to provide control outputs for a driver circuit 740 based on processing of various input information, programming information, control algorithms and/or the like. The processing circuitry 710 may be configured to perform data processing, control function execution and/or other processing and management services according to an example embodiment of the present invention. In some embodiments, the processing circuitry 710 may be embodied as a chip or chip set. In other words, the processing circuitry 710 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 710 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 710 may include one or more instances of a processor 712 and memory 714 that may be in communication with or otherwise control a device interface 720 and, in some cases, a user interface 730. As such, the processing circuitry 710 may be embodied as a circuit chip (e.g., an integrated circuit chip) configured (e.g., with hardware, software or a combination of hardware and software) to perform operations described herein. However, in some embodiments, the processing circuitry 710 may be embodied as a portion of an on-board computer. In some embodiments, the processing circuitry 710 may communicate with various components, entities, sensors and/or the like, which may include, for example, the driver circuit 710 and/or a plasma density sensor (e.g., an interferometer) that is configured to measure plasma density in the plasma elements 220.

The user interface 730 (if implemented) may be in communication with the processing circuitry 710 to receive an indication of a user input at the user interface 730 and/or to provide an audible, visual, mechanical or other output to the user. As such, the user interface 730 may include, for example, a display, one or more levers, switches, indicator lights, touchscreens, buttons or keys (e.g., function buttons), and/or other input/output mechanisms. The user interface 730 may be used to select channels, frequencies, modes of operation, programs, instruction sets, or other information or instructions associated with operation of the driver circuit 740 and/or the plasma elements 220.

The device interface 720 may include one or more interface mechanisms for enabling communication with other devices (e.g., modules, entities, sensors and/or other components). In some cases, the device interface 720 may be any means such as a device or circuitry embodied in either hardware, or a combination of hardware and software that is configured to receive and/or transmit data from/to modules, entities, sensors and/or other components that are in communication with the processing circuitry 710.

The processor 712 may be embodied in a number of different ways. For example, the processor 712 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 712 may be configured to execute instructions stored in the memory 714 or otherwise accessible to the processor 712. As such, whether configured by hardware or by a combination of hardware and software, the processor 712 may represent an entity (e.g., physically embodied in circuitry—in the form of processing circuitry 710) capable of performing operations according to embodiments of the present invention while configured accordingly. Thus, for example, when the processor 712 is embodied as an ASIC, FPGA or the like, the processor 712 may be specifically configured hardware for conducting the operations described herein. Alternatively, as another example, when the processor 712 is embodied as an executor of software instructions, the instructions may specifically configure the processor 712 to perform the operations described herein.

In an example embodiment, the processor 712 (or the processing circuitry 710) may be embodied as, include or otherwise control the operation of the controller 700 based on inputs received by the processing circuitry 710. As such, in some embodiments, the processor 712 (or the processing circuitry 710) may be said to cause each of the operations described in connection with the controller 700 in relation to adjustments to be made to plasma density patterns in the radome structure 200 responsive to execution of instructions or algorithms configuring the processor 712 (or processing circuitry 710) accordingly. In particular, the instructions may include instructions for altering the configuration and/or operation of one or more instances of the plasma elements 220 as described herein. The control instructions may mitigate interference, conduct load balancing, implement antenna beam steering, select an operating frequency/channel, select a mode of operation, increase efficiency or otherwise improve performance of an antenna assembly through the control of the plasma element 220 as described herein.

In an exemplary embodiment, the memory 714 may include one or more non-transitory memory devices such as, for example, volatile and/or non-volatile memory that may be either fixed or removable. The memory 714 may be configured to store information, data, applications, instructions or the like for enabling the processing circuitry 710 to carry out various functions in accordance with exemplary embodiments of the present invention. For example, the memory 714 could be configured to buffer input data for processing by the processor 712. Additionally or alternatively, the memory 714 could be configured to store instructions for execution by the processor 712. As yet another alternative, the memory 714 may include one or more databases that may store a variety of data sets responsive to input sensors and components. Among the contents of the memory 714, applications and/or instructions may be stored for execution by the processor 712 in order to carry out the functionality associated with each respective application/instruction. In some cases, the applications may include instructions for providing inputs to control operation of the controller 700 as described herein.

As shown in FIG. 12, the plasma elements 220 are operably coupled to the driver circuit 740. The driver circuit 740 may also be operably coupled to the controller 700 and may interact with the plasma elements via the electrodes (e.g., first and second control surfaces 230 and 232) disposed at respective ends of the plasma elements 220. The driver circuit 740 may selectively ionize portions of the first and second control surfaces 230 and 232 to control plasma density in individual selected ones of the plasma elements 220 as described above. In some cases, the plasma elements 220 may be operated based on a feedback loop of instructions and information where the feedback loop includes the driver circuit 740 (operating under the control of the controller 700), the plasma element 220 and some external component (e.g., an interferometer) for communicating current plasma density information regarding each of the plasma elements 220. In particular, for example, the controller 700 may provide instructions to the driver circuit 740 regarding ionization patterns and levels of the plasma in the plasma elements 220 to achieve certain functional characteristics in the performance of the entire antenna assembly with which the radome structure 200 and the plasma elements 220 are employed. The driver circuit 740 may then operate to control plasma density in the plasma elements 220 based on the instructions from the controller 700.

Accordingly, for example, the controller 700 may define a target plasma density for the individual ones of the plasma elements 220 and the driver circuit 740 may be operated to provide current pulses to the plasma elements 220 to ionize the gas therein to the corresponding target plasma density. Any change in target plasma density triggered by user input or by programmed operation of the controller 700 may then cause a corresponding change in operation of the driver circuit 740 to achieve the new target plasma density.

Example embodiments may operate over a range of frequencies that may be required for various different applications. However, it should be noted specifically that example embodiments can also work well at frequencies above 800 MHz due to the ability of the driver circuit 740 to generate fast, high current pulses. As can be appreciated from the descriptions above, one or more of the plasma elements 220 may be configured to support wireless communication between external communication equipment and a platform employing the one or more antenna assembly having the radome structure 200 and corresponding plasma elements 220. The provision of the plasma elements 220 for communications support may provide for configurable communications capabilities while minimizing the penetrations through the fuselage of an aircraft and may also minimize the drag associated with providing communications antennas for the aircraft. However, numerous other platforms may also benefit from employing example embodiments of the plasma elements 220 employed as described herein.

Plasma frequency is related to plasma density, and thus, the controller 700 can also or alternatively be configured to control the frequency of any array employing plasma elements simply by controlling the plasma density as described herein. In any case, the controller 700 may also be configured to control the plasma elements and/or their respective antenna assemblies to perform time and/or frequency multiplexing so that many RF subsystems (e.g., multiple different radios associated with the radio circuitry) may share the same antenna resources. In situations where the frequencies are relatively widely separated, the same aperture may be used to transmit and receive signals in an efficient manner. In some embodiments, higher frequency plasma antenna arrays may be arranged to transmit and receive through lower frequency plasma antenna arrays. Thus, for example, the antenna arrays (assuming they also employ plasma elements of some sort) may be nested in some embodiments such that higher frequency plasma antenna arrays are placed inside lower frequency plasma antenna arrays.

In some embodiments, multiple reconfigurable or preconfigured antenna elements may be provided to enable communications over a wide range of frequencies covering nearly the entire spectrum, or at least being capable of providing such coverage based on relatively minimal changes to controllable and selectable characteristics of the radome structure 200 and the components associated therewith by the controller 700. Some ranges or specific frequencies may be emphasized for certain commercial reasons (e.g., 790 MHz to 6 GHz, 2.4 GHz, 5.8 GHz, 14 GHz, 26 GHz, 58 GHz, etc.). However, in all cases, the controller 700 may be configured to provide at least some control over the frequencies, channels, multiplexing strategies, beam forming, or other technically enabling programs that are employed. Because plasma elements can be 'tuned' rapidly, fast switching could also accomplish the same goal of using the same physical plasma element to communicate at high speed with multiple devices in a time-division duplexed fashion.

As mentioned above, beam forming capabilities may be enhanced or provided by the controller 700 exercising control over the plasma elements 220. In this regard, for example, when the plasma elements 220 include layers, the layers may be individually operated to define patterns to allow narrow beam formation and steering. Thus, the controller 700 may control the radome structure 200 to generate reflective properties or employ beam collimation so that beam steering may be accomplished. In such an example, the controller 700 may be configured to control the plasma elements 200 to focus or steer radiation patterns passing through the radome structure 200 to allow shaping and steering of beams without the use of a phased array antenna.

Regardless of whether the plasma elements 220 are used to facilitate operation of an antenna assembly to radiate, receive, focus beams, steer beams, reflect beams or otherwise conduct some form of beamforming function, the controller 700 may be used to control the operation of the plasma elements 220 to achieve the desired functionality, but further enable the plasma elements to be operated efficiently and intelligently in cooperation with the antenna element that the radome structure 200 covers.

In some embodiments, the controller that performs the method above (or a similar controller) may be a portion of an antenna assembly or system. The system or assembly may include an antenna element, a radome structure disposed proximate to the antenna element and including a plurality of plasma elements, a driver circuit operably coupled to the plasma elements to selectively ionize individual ones of the plasma elements, and a controller. The controller may be operably coupled to the driver circuit to provide control of plasma density of the individual ones of the plasma elements. The plasma elements may include respective enclosures. At least some of the enclosures may have at least two (or in some cases all) peripheral edge surfaces substantially fully contacted by corresponding peripheral edge surfaces of adjacent enclosures at at least one section along a longitudinal length thereof.

In some embodiments, the assembly described above may include additional and/or optional components and/or the components described above may be modified or augmented. Some examples of modifications, optional changes and augmentations are described below. It should be appreciated that the modifications, optional changes and augmentations may each be added alone, or they may be added cumulatively in any desirable combination. In an example embodiment, the at least some of the enclosures may have a hexagonal cross sectional shape. In an example embodiment, opposing longitudinal ends of the plasma elements may be operably coupled to first and second control surfaces, respectively. Additionally, the driver circuit may be operably coupled to the first and second control surfaces to selectively ionize the individual ones of the plasma elements. In some examples, selectively ionizing the individual ones of the plasma elements may further define a corresponding plasma density within the individual ones of the plasma elements. In an example embodiment, the radome structure may include at least some elements that are non-plasma elements. In some cases, the non-plasma elements may be defined by enclosures filled with dielectric or metallic materials. In an example embodiment, the radome structure may include a first layer of plasma elements in which respective plasma elements each lie substantially parallel to each other, and a second layer of plasma elements in which corresponding plasma elements each lie substantially parallel to each other and substantially orthogonal to the respective plasma elements of the first layer of plasma elements. In some examples, the controller may be configured to define a first group of plasma elements having a first plasma density and a second group of plasma elements having a second plasma density different than the first plasma density within the first layer, and the controller may be configured to define a third group of plasma elements having a third plasma density and a fourth group of plasma elements having a fourth plasma density different than the third plasma density in the second layer to control a radiation pattern leaving the radome structure. In some embodiments, the controller may be configured to define a first group of plasma elements having a first plasma density and a second group of plasma elements having a second plasma density different than the first plasma density to control a radiation pattern leaving the radome structure. In an example embodiment, the controller may be configured to adjust plasma density in selected ones of the plasma elements to define and steer a beam passing through the radome structure. Additionally or alternatively, the controller may be configured to adjust plasma density in selected ones of the plasma elements to define and steer multiple beams passing through the radome structure simultaneously. In an example embodiment, the antenna element may be a conformal antenna configuration or micropatch antenna and the antenna element may be disposed at a surface of an aircraft or other large structure such as a ground station.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An antenna assembly comprising:

an antenna element;

a radome structure disposed proximate to the antenna element, the radome structure comprising a plurality of plasma elements;

a driver circuit operably coupled to the plasma elements to selectively ionize individual ones of the plasma elements; and a controller operably coupled to the driver circuit to provide control of plasma density of the individual ones of the plasma elements, wherein the plasma elements include respective enclosures, at least some of the enclosures having at least four peripheral edge surfaces substantially fully contacted by corresponding peripheral edge surfaces of adjacent enclosures at at least one section along a longitudinal length thereof.

2. The antenna assembly of claim 1, wherein the at least some of the enclosures have a hexagonal cross sectional shape and all peripheral edge surfaces of the at least some of the enclosures having the hexagonal cross sectional shape are substantially fully contacted by the corresponding peripheral edge surfaces of the adjacent enclosures.

3. The antenna assembly of claim 1, wherein opposing longitudinal ends of the plasma elements are operably coupled to first and second control surfaces, respectively, and wherein the driver circuit is operably coupled to the first and second control surfaces to selectively ionize the individual ones of the plasma elements.

4. The antenna assembly of claim 3, wherein selectively ionizing the individual ones of the plasma elements further defines a corresponding plasma density within the individual ones of the plasma elements.

5. The antenna assembly of claim 1, wherein the radome structure includes at least some elements that are non-plasma elements.

6. The antenna assembly of claim 5, wherein the non-plasma elements are defined by enclosures filled with dielectric or metallic materials.

7. The antenna assembly of claim 1, wherein the radome structure comprises a first layer of plasma elements in which respective plasma elements each lie substantially parallel to each other, and a second layer of plasma elements in which corresponding plasma elements each lie substantially parallel to each other and substantially orthogonal to the respective plasma elements of the first layer of plasma elements.

8. The antenna assembly of claim 7, wherein the controller is configured to define a first group of plasma elements having a first plasma density and a second group of plasma elements having a second plasma density different than the first plasma density within the first layer, and wherein the controller is configured to define a third group of plasma elements having a third plasma density and a fourth group of plasma elements having a fourth plasma density different than the third plasma density in the second layer to control a radiation pattern leaving the radome structure.

9. The antenna assembly of claim 1, wherein the radome structure comprises a first layer of plasma elements in which respective plasma elements each lie substantially parallel to each other, and a second layer of plasma elements in which corresponding plasma elements each lie substantially parallel to each other and lie at an angle that is neither parallel nor orthogonal to the respective plasma elements of the first layer of plasma elements.

10. The antenna assembly of claim 1, wherein the controller is configured to define a first group of plasma elements having a first plasma density and a second group of plasma elements having a second plasma density different than the first plasma density to control a radiation pattern leaving the radome structure.

11. The antenna assembly of claim 1, wherein the controller is configured to adjust plasma density in selected ones of the plasma elements to define and steer a beam passing through the radome structure.

12. The antenna assembly of claim 1, wherein the controller is configured to adjust plasma density in selected ones of the plasma elements to define and steer multiple beams passing through the radome structure simultaneously.

13. The antenna assembly of claim 1, wherein the antenna element comprises a conformal antenna configuration disposed at a surface of an aircraft or other large structure.

14. A radome structure for an antenna assembly, the radome structure comprising a plurality of plasma elements operably coupled to a driver circuit, the driver circuit being configured to selectively ionize individual ones of the plasma elements responsive to operation of a controller operably coupled to the driver circuit to provide control of a plasma density of the individual ones of the plasma elements, wherein the plasma elements include respective enclosures, at least some of the enclosures having at least four peripheral edge surfaces substantially fully contacted by corresponding peripheral edge surfaces of adjacent enclosures at at least one section along a longitudinal length thereof.

15. The radome structure of claim 14, wherein the at least some of the enclosures have a hexagonal cross sectional shape and all peripheral edge surfaces of the at least some of the enclosures having the hexagonal cross sectional shape are substantially fully contacted by the corresponding peripheral edge surfaces of the adjacent enclosures.

16. The radome structure of claim 14, wherein opposing longitudinal ends of the plasma elements are operably coupled to first and second control surfaces, respectively, and wherein the driver circuit is operably coupled to the first and second control surfaces to selectively ionize the individual ones of the plasma elements.

17. The radome structure of claim 14, wherein the radome structure includes at least some elements that are non-plasma elements defined by enclosures filled with dielectric or metallic materials.

18. The radome structure of claim 14, wherein the radome structure comprises a first layer of plasma elements in which respective plasma elements each lie substantially parallel to each other, and a second layer of plasma elements in which corresponding plasma elements each lie substantially parallel to each other and substantially orthogonal to the respective plasma elements of the first layer of plasma elements.

19. The radome structure of claim 14, wherein the plasma density of each of the plasma elements is individually controllable to define a first group of plasma elements having a first plasma density and a second group of plasma elements having a second plasma density different than the first plasma density to control a radiation pattern leaving the radome structure.

20. The radome structure of claim 14, wherein the plasma density in selected ones of the plasma elements is adjustable to define and steer a beam passing through the radome structure.

21. The radome structure of claim 14, wherein the plasma density in selected ones of the plasma elements is adjustable to define and steer multiple beams passing through the radome structure simultaneously.

22. The radome structure of claim 14, wherein the radome structure comprises a first layer of plasma elements in which respective plasma elements each lie substantially parallel to each other, and a second layer of plasma elements in which corresponding plasma elements each lie substantially parallel to each other and lie at an angle that is neither parallel nor orthogonal to the respective plasma elements of the first layer of plasma elements.

* * * * *